US006822178B1

(12) United States Patent
Billings et al.

(10) Patent No.: US 6,822,178 B1
(45) Date of Patent: Nov. 23, 2004

(54) CLUSTER ASSEMBLY

(75) Inventors: Christopher Billings, Napa, CA (US); Jose M. Gomes, Napa, CA (US); Keith I. Gray, Napa, CA (US); Jose A. Robledo, Napa, CA (US)

(73) Assignee: Pacific Breaker Systems, Inc., Napa, CA (US)

( * ) Notice: Subject to any disclaimer, the term of this patent is extended or adjusted under 35 U.S.C. 154(b) by 15 days.

(21) Appl. No.: 10/705,304

(22) Filed: Nov. 10, 2003

(51) Int. Cl.[7] ..... H01H 5/00
(52) U.S. Cl. ..... 200/400; 200/401; 439/181
(58) Field of Search ..... 200/400, 401, 200/500, 501, 50.21, 50.22, 50.24; 439/181–187

(56) References Cited

U.S. PATENT DOCUMENTS 4,028,513 A * 6/1977 Laubach ..... 218/1
4,933,519 A * 6/1990 Milianowicz et al. ..... 218/22
5,200,585 A * 4/1993 Davies et al. ..... 200/50.22
5,224,590 A * 7/1993 Milianowicz et al. ..... 200/400
5,550,707 A * 8/1996 Iversen ..... 361/617
5,734,547 A * 3/1998 Iversen ..... 361/617
6,040,538 A * 3/2000 French et al. ..... 200/293

* cited by examiner

*Primary Examiner*—K. Lee
(74) *Attorney, Agent, or Firm*—Charles L. Thoeming

(57) ABSTRACT

Cluster assemblies for both low and medium voltage applications which allow a movable circuit breaker to connect to a fixed part of the switchgear. The assembly apparatus comprises a plurality of conducting bridge elements consisting of resilient finger springs held in a predetermined geometrical configuration by a guide plate and a locator plate, wherein the locator plate is fixedly attached to a conductor. The resilient finger springs act to engage and hold a second conductor, thus making the electrical connection. The apparatus is scalably configured to address any range of low and medium voltage current necessary to be carried by the switchgear using simple and easily manufactured components.

24 Claims, 4 Drawing Sheets

10

20

30

28

70
150
69

65
60

67

70
150

65
60

67

CLUSTER ASSEMBLY

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

Field of the Invention

The present invention relates generally to the field of contact assemblies for switchgear apparatus, and more specifically to cluster assemblies for both low and medium voltage applications which allow a movable circuit breaker to connect to a fixed part of the switchgear.

BRIEF SUMMARY OF THE INVENTION

Switchgear assemblies for both low and medium voltage applications use contact assemblies that allow a movable circuit breaker to connect to a fixed part of the switchgear. The means of making this connection is accomplished by copper fingers that are spring loaded and which bridge between conductors of uniform geometrical shape including, but not limited to round and rectangular conductors. Many different types of springs are used in these assemblies including compression, tension and leaf styles. For each embodiment of the present invention, the means of retaining the fingers and springs has varied widely as required to satisfy the particular size and geometry of conductor.

DETAILED DESCRIPTION OF THE INVENTION

Figure 1:
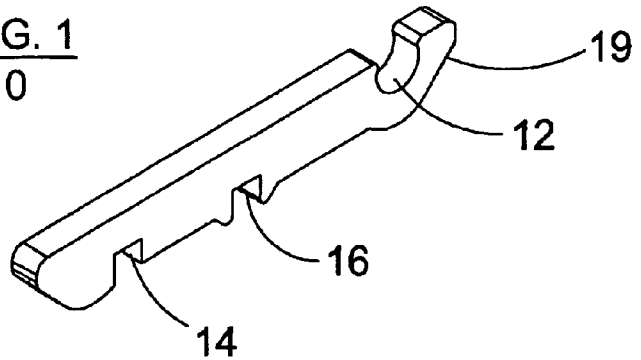
FIG. 1 is a perspective view of a finger element of an embodiment of the present invention.

The apparatus of the present invention comprises a primary finger 10 as depicted in FIG. 1. The primary finger 10 is produced by stamping or similar high volume process from high conductivity copper. The primary finger 10 is common to all designs or embodiments of the present invention so that economical high volume production methods can be employed. The primary finger 10 further comprises a predetermined width, a predetermined length, a center point midway along the finger length, two ends, a top side comprising a circular spring locator 12 located at one end of the finger top side, and a bottom side comprising a locator slot 14 located at the end of the bottom side opposite from the end of the finger having the circular spring locator 12 and a guide slot 16 located on the finger bottom at a point slightly off the center point of the finger towards the locator slot 14. The preferred embodiment of finger 10 is 0.155 inches thick; however a specific thickness is not necessarily determinative of how the finger functions. As shown, for example in FIG. 7C, the slot width 150 in which one or more fingers 10 will be inserted is sized to accommodate the number of fingers desired per slot and the total finger width. The finger end opposite the end of the locator slot 14 is angled at 45 degrees to form a conical or ramped shaped tip 19, FIGS. 1 and 5.

Figure 2:
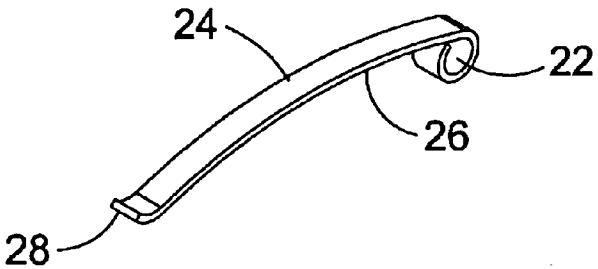
FIG. 2 is a perspective view of a finger spring element of an embodiment of the present invention.

A finger spring 20, FIG. 2, of an embodiment of the present invention comprises a formed circular end 22, a deformed convex top side 24, a deformed concave bottom side 26, and a foot end 28, wherein the deformed top and bottom sides define a leaf spring mechanism. The preferred embodiment of finger spring 20 is made of spring steel and is 18 gauge thick, 0.150 inches wide, and about 2 inches long to provide the requisite load contact force in the deformed state. The finger spring 20 is also common to all designs or embodiments of the present invention and again high volume production methods allow for an economical part.

Figure 3:
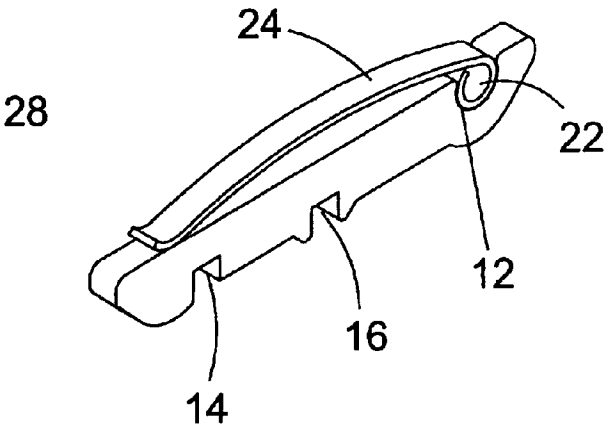
FIG. 3 is a perspective view of a resilient finger spring assembly of the finger element depicted in FIG. 1 and the spring element depicted in FIG. 2.

As shown in FIG. 3, the finger 10 and spring 20 are assembled by locating the formed circular end 22 of the spring 20 into the circular spring locator 12 of the finger 10, aligning the spring leaf so that the spring convex top side 24 bows above the finger top side, and the spring foot 28 rests on the finger top side providing the resilient finger spring assembly 30.

Figure 5:
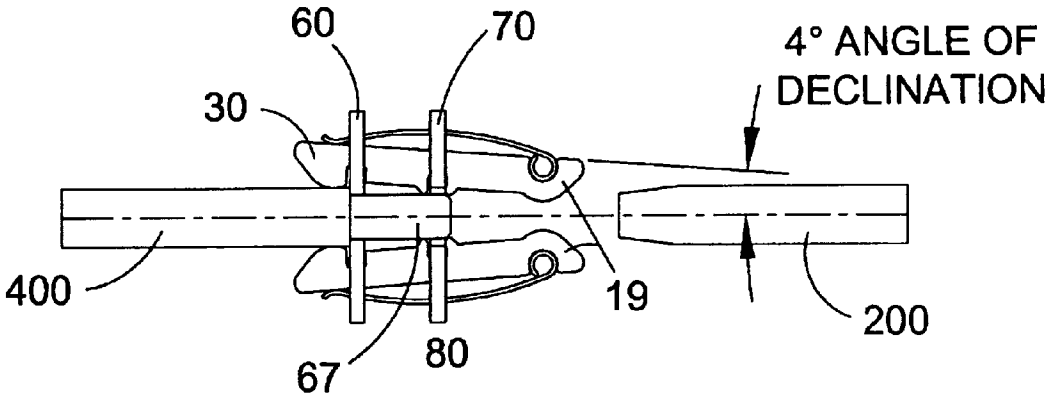
FIG. 5 is a side view of disconnected cluster assembly of an embodiment of the present invention.
Figure 6:
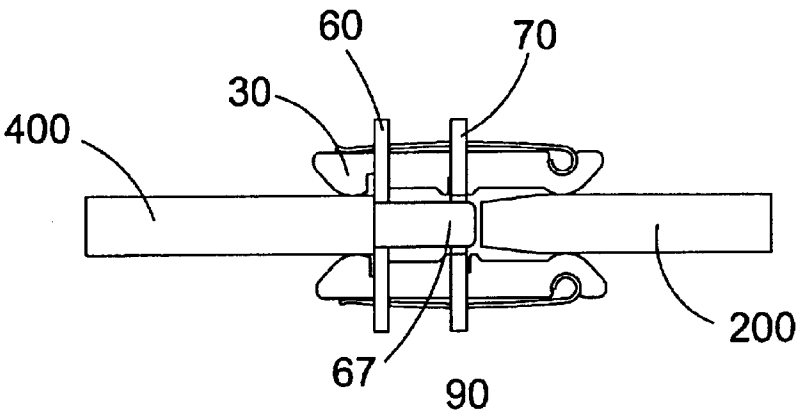
FIG. 6 is a side view of connected cluster assembly of an embodiment of the present invention.
Figure 4:
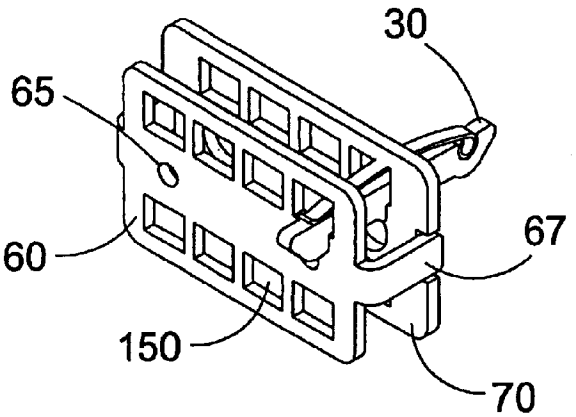
FIG. 4 is a perspective view of a partial assembly of the finger and spring assembly, locator, and guide of an embodiment of the present invention.

In order to retain the finger spring assembly 30 and have it cooperate with the fixed side of a conductor, two flat metal plates constructed from non-magnetic steel are used, FIGS. 4–6. Both plates comprise front and back surfaces which are identically sized by width and length and which have identical geometries. Both plate surfaces further comprise plate edges of a predetermined plate thickness, and have an array of identically sized and located slots 150. One of the two plates is a locator plate 60 and the other plate is a guide plate 70. The locator plate comprises means by which it can be fixedly connected to the fixed part of the conductor 400.

The locator plate 60 further comprises means to attach to the guide plate 70 other than the resilient finger spring assemblies on certain embodiments of the present invention. For example, where locator and guide plate geometries are rectangular, the means by which the locator plate 60 cooperates with the guide plate 70 further comprises two fixed arms 67 extending at right angles from the locator plate 60 front surface for a predetermined length such that it extends past the guide plate 70. The guide plate 70 further comprises two notches on each side that the locator plate fixed arms 67 pass through. The dimension between the fixed arms 67 is larger than the distance between the vertical surfaces of the two notches of the guide plate 70. The clearance resulting from the difference between the two dimensions limits the side-to-side motion of the guide plate 70 and thus the outer ends of each finger 10. The dimensional height of the fixed arms 67 is also slightly smaller than the dimensional height of the guide plate side notches. Again the clearance between these corresponding elements limits the up and down motion of the guide plate and thus the outer, tapered tips 19 of the fingers 10. Limiting the side-to-side and up and down motions of each finger 10 is critical to ensure that each finger 10 aligns with the conductor 200 so that each finger 10 properly engages with the conductor 200 but the clearance also allows for some misalignment between conductors 200 and 400.

The cluster assembly is held together by the location of the finger slots 14 and 16 in each of the locator plate 60 and the guide plate 70, respectively, and the action of the finger spring 20 holding them in place. The resilient finger spring assembly position allows sufficient movement of the oppositely opposed resilient finger spring assembly to receive and engage the movable conductor element tapered tip and full element width, and wherein such oppositely opposed pair of resilient finger spring assemblies for rectangular locator and guide plate geometries define a gap distance between the tapered finger assembly edges which is smaller than the width of the movable conductor element. In the case of the circular cluster assemblies and locator/guide plate geometries, FIGS. 10A–12C, the circular array of the resilient finger spring assemblies and the dimensions of the parts both limit the total motion of the fingers relative to the centerline of the assembly but allow for misalignment of the conductor centerlines.

In an embodiment of the present invention, FIGS. 4, 5, 8B, and 8C, the locator plate 60 and the guide plate 70 are each 10 gauge thick, and the means by which the locator plate can be fixedly connected to the fixed part of the conductor further comprises locator plate openings 65 and guide plate openings 69 for receiving means to bolt the plate to the conductor 400. In an embodiment of the present invention using rectangular locator and guide plate geometries, the means by which the locator plate 60 connects to the guide plate 70 further comprises two fixed arms 67 extending at a right angles from the locator plate 60 front surface for a predetermined length towards the locator plate 60 rear surface and beyond, and terminating in connection with the guide plate 70 notched edges. The predetermined length of the fixed arms 67 corresponds to the distance between the finger locator slot 14 and the finger guide slot 16 so that when the locator plate 60 is attached to the guide plate 70, each finger slot can receive its respective plate when the finger is positioned into one of the array of corresponding plate slots. These locator and guide plates can be manufactured using numerically controlled laser cutting equipment known in the art. This production process easily can vary the plate sizes and shapes to economically produce smaller numbers of parts.

Figures 7A, 7B, 7C, 8A, 8B, 8C, 9A, 9B, 9C:
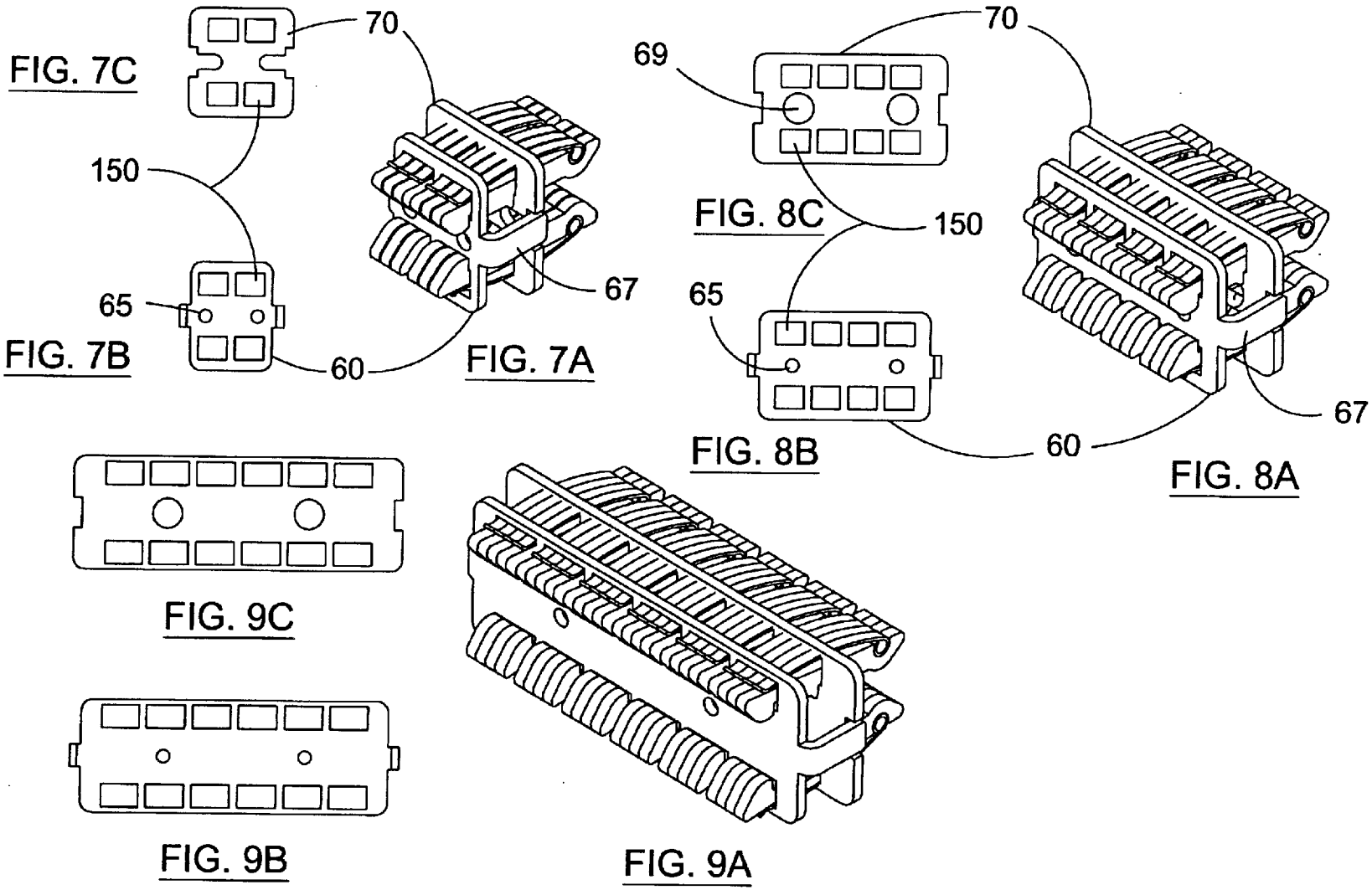
FIG. 7A is a perspective view of a 12 finger rectangular cluster assembly of an embodiment of the present invention.
FIG. 7B is an end view of typical locator plate for a 12 finger rectangular cluster assembly of an embodiment of the present invention.
FIG. 7C is an end view of typical guide plate for a 12 finger rectangular cluster assembly of an embodiment of the present invention.
FIG. 8A is a perspective view of a 24 finger rectangular cluster assembly of an embodiment of the present invention.
FIG. 8B is an end view of typical locator plate for a 24 finger rectangular cluster assembly of an embodiment of the present invention.
FIG. 8C is an end view of typical guide plate for a 24 finger rectangular cluster assembly of an embodiment of the present invention.
FIG. 9A is a perspective view of a 58 finger rectangular cluster assembly of an embodiment of the present invention.
FIG. 9B is an end view of typical locator plate for a 58 finger rectangular cluster assembly of an embodiment of the present invention.
FIG. 9C is an end view of typical guide plate for a 58 finger rectangular cluster assembly of an embodiment of the present invention.
Figure 11C:
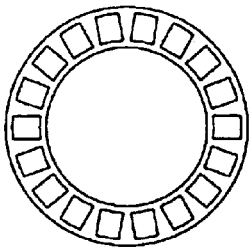
FIG. 11C is an end view of typical guide plate for a 36 finger circular cluster assembly of an embodiment of the present invention.
Figure 11A:
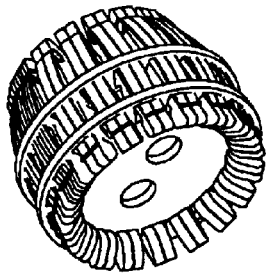
FIG. 11A is a perspective view of a 36 finger circular cluster assembly of an embodiment of the present invention.
Figure 11B:
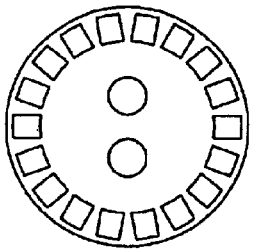
FIG. 11B is an end view of typical locator plate for a 36 finger circular cluster assembly of an embodiment of the present invention.
Figure 10C:
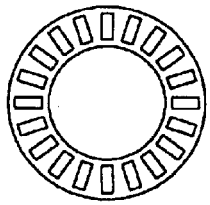
FIG. 10C is an end view of typical guide plate for a 20 finger circular cluster assembly of an embodiment of the present invention.
Figure 10A:
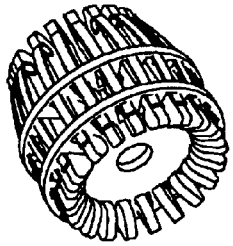
FIG. 10A is a perspective view of a 20 finger circular cluster assembly of an embodiment of the present invention.
Figure 10B:
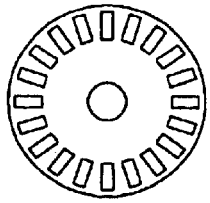
FIG. 10B is an end view of typical locator plate for a 20 finger circular cluster assembly of an embodiment of the present invention.
Figure 12C:
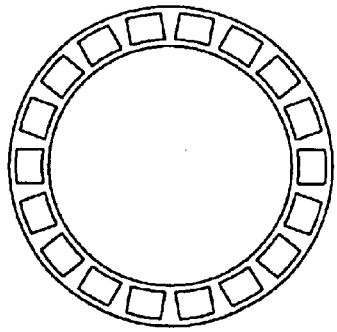
FIG. 12C is an end view of typical guide plate for a 54 finger circular cluster assembly of an embodiment of the present invention.
Figure 12A:
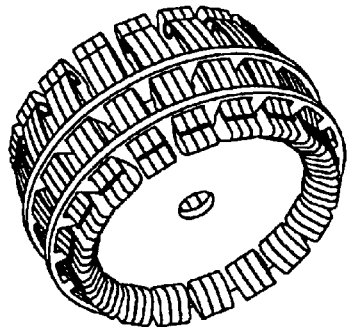
FIG. 12A is a perspective view of a 54 finger circular cluster assembly of an embodiment of the present invention.
Figure 12B:
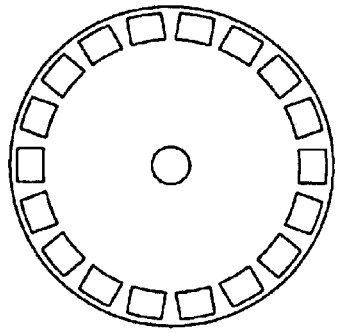
FIG. 12B is an end view of typical locator plate for a 54 finger circular cluster assembly of an embodiment of the present invention.

As shown in the partial assembly of an embodiment of the present invention using rectangular locator/guide plate geometries, FIGS. 4, 8B, and 8C, after the locator plate 60 has been attached to the guide plate 70 by means of securing the locator plate arms 67 into the guide plate notches 69, one finger spring assembly 30 is located in the first slot in the array of plate slots of a partial assembly. The locator slot 14 in the finger bottom is positioned such that the locator plate 60 fits in to the locator slot 14 and holds the spring assembly 30 in place, FIGS. 4–6. As depicted in FIGS. 4 and 5, the leaf spring contacts the guide plate 70 at the top of the respective guide plate slot while the finger guide slot 16 receives the guide plate, wherein the guide plate also secures the spring assembly 30. The finger guide slot 16 depth is such that the leaf spring is deformed from its free state and therefore holds the finger 10 against the bottom of the respective guide plate slot. With this configuration, FIG. 5, the finger 10 is held so that it is at an approximate 4 degree angle of declination measured from the centerline of the conductor 200 in a disconnected state. In the disconnected state, the conductor centerlines are misaligned. The conductor cross-sections are either round or rectangular; however the cross-section of the conductor 400 to which the locator plate 70 is fixedly attached is the same as the cross-section of the conductor 200 to which the cluster assembly engages. As further depicted in FIG. 5, at this 4 degree angle of declination, the gap between the two fingers is smaller than the width of the conductor 200 to be received. Once the cluster assembly engages the conductor 200 and is connected, the finger spring 20 further deforms and the finger 10 angle becomes nearly parallel to the centerline of the conductor 200, FIG. 6, and the conductor centerlines are then aligned.

The tip of the conductor 200 to be received is shaped with corresponding 45 degree angles so that each finger end 19 engages the conductor 200 first at this angled tip, FIG. 5. Once the cluster 40 is connected to the conductor 200, FIG. 6, the corresponding finger 10 of the finger spring assemblies 30 moves to a parallel position relative to the conductor 200 centerline. The top of the corresponding guide plate 70 slot further causes deformation of the resilient finger spring 20 and each finger 10 now contacts both conductors. The force on each conductor is equal since the guide plate 70 is midway between the raised contact sections of the fingers. The force exerted in the connected cluster is sufficient to ensure good contact between the fingers and the conductors and to allow transfer of electrical current between the two conductors.

Low and medium switchgear require differing levels of rated normal current be carried. These rated currents range from 600 amps to as much as 6,000 amps. The sizes and shapes of conductors to adequately carry this range of current vary and no single design is possible. A number of possible embodiments are depicted in FIGS. 7A–12C. All of these embodiments use the same primary finger and finger spring components which can be produced in high volume and low cost. Each of the corresponding locator plates and guide plates are shaped and sized to suit the conductor profile employed for the specific current rating and type of circuit breaker. The locator plates and guide plates are manufactured by a process which easily and economically can produce the lower volume variable parts. As depicted in FIGS. 7A–12C, it is possible to install more than one resilient finger spring assembly in each plate slot. Up to four resilient finger spring assemblies per slot have been successfully used, though four is by no means a limit. As depicted in FIGS. 10A–12C, the circular locator and guide plates do not require attachment means between the plates other than the resilient finger spring assemblies, and the circular guide plates do not require access means to bolt the plate assemblies to the fixed conductor since the guide plate opening itself provides this access. The suitable array of locator/guide plate slots and the number of resilient finger spring assemblies per slot are determined by the current rating desired.

Therefore, the disclosed invention provides cluster assemblies for switchgear which are uncomplicated, use few and easily manufactured parts, achieve a high degree of precision location and orientation, and eliminate design complexity and tedious assembly procedures. It will be understood that, while presently preferred embodiments of the invention have been illustrated and described, the invention is not limited thereto, but may be otherwise variously embodied within the scope of the following claims.

We claim:

1. Cluster assembly apparatus for both low and medium voltage switchgear applications, the apparatus comprising:

at least one fixed conductor element comprising a predetermined cross-sectional area and a longitudinal axis defining a centerline;

at least one movable conductor element comprising a cross-sectional area corresponding to the fixed conductor element, a predetermined width, a longitudinal axis defining a centerline, and a dual 45 degree angled tapered tip, and wherein the fixed conductor and movable conductor elements are misaligned when the assembly is not engaged;

resilient spring loaded connecting means fixedly attached to each fixed conductor element wherein at least one conducting bridge element provides electrical connection between a fixed conductor and a movable conductor when the cluster assembly is in a connected state;

means to fixedly attach the resilient spring loaded connecting means to each fixed conductor element; and means to guide the resilient spring loaded connecting means to receive and engage the movable conductor element thus providing the cluster assembly connected state wherein corresponding conductor centerlines are aligned.

2. The apparatus of claim 1, wherein each conducting bridge element further comprises at least two primary fingers, each finger comprising a predetermined width, a predetermined length, a center point midway along the finger length, two ends, a top side comprising a circular spring locator to receive a spring assembly therein towards one end, and a bottom side comprising a locator slot located at the end of the bottom side opposite from the finger end having the circular spring locator, a guide slot located on the finger bottom side at a point slightly off the center point of the finger towards the locator slot, and a 45 degree taper on the end nearest the circular spring locator.

3. The apparatus of claim 2, wherein the spring loaded connecting means further comprises a finger spring for each finger, comprising a formed circular end suitably sized to be positioned within the finger top side spring locator, a deformed convex top side, a deformed concave bottom side, and a foot end wherein the deformed convex top side and the deformed concave bottom side define a leaf spring mechanism, wherein the finger spring formed circular end is positioned within the finger top side spring locator aligning the leaf spring mechanism so that the spring convex top side bows above the finger top side, and wherein the spring foot: end rests on the finger top side providing a resilient finger spring assembly.

4. The apparatus of claim 3, wherein the means to fixedly attach the resilient spring loaded connecting means to each fixed conductor element further comprises a flat non-magnetic metal locator plate of a predetermined surface geometry and size further comprising a front surface, a back surface, a predetermined plate thickness, an array of slots of predetermined size and geometry through the plate surface to provide housing for at least one pair of oppositely opposed resilient finger spring assemblies wherein each such slot has a bottom edge, a top edge, and a predetermined width, and means for fixedly connecting the locator plate to a fixed conductor.

5. The apparatus of claim 4, wherein means to guide the resilient spring loaded connecting means to receive and engage the movable conductor element further comprises a flat non-magnetic metal guide plate comprising a surface geometry and size identical to the locator plate, and further comprising a front surface, a back surface, two vertical sides defining a predetermined plate thickness, an array of slots identical in size, location and geometry to the slots in the locator plate through the guide plate surface to provide housing for a plurality of oppositely opposed resilient finger spring assemblies wherein each such slot has a bottom edge, a top edge, and a predetermined width, and means for accessing means for fixedly connecting the locator plate to a fixed conductor element.

6. The apparatus of claim 5, wherein the spring loaded connecting means further comprises at least two resilient finger spring assemblies positioned and residing within corresponding locator plate and guide plate slots by alignment of the respective finger locator slot for the locator plate and finger guide slot for the guide plate to positionally receive the corresponding edge of the locator plate and guide plate, wherein the finger spring deformed convex top side engages the corresponding locator plate and guide plate edges to secure each resilient finger spring assembly at an angle of declination of four degrees from the centerline of the movable conductor element while allowing sufficient movement of the oppositely opposed resilient finger spring assemblies to receive and engage the movable conductor element tapered tip and full element width, and wherein such oppositely opposed pair of resilient finger spring assemblies defines a gap distance between the tapered finger assembly edges which is smaller than the width of the movable conductor element.

7. The apparatus of claim 6, wherein the spring loaded connecting means further comprises an angle of declination of each resilient finger spring assembly of zero degrees from the centerline of the movable conductor element once the movable conductor element is engaged by the resilient finger spring assemblies.

8. The apparatus of claim 7, wherein the primary finger further comprises high conductivity copper 0.155 inches in thickness, and the primary finger is produced by stamping or similar high volume process.

9. The apparatus of claim 7, wherein the finger spring further comprises spring steel 18 gauge thick, 0.150 inches wide, and approximately 2 inches long, and the finger spring is produced by stamping or similar high volume process.

10. The apparatus of claim 7, wherein the locator plate and guide plate are each 10 gauge thick, and are manufactured using numerically controlled laser cutting equipment to easily vary plate sizes and shapes and to economically produce smaller numbers of parts.

11. The apparatus of claim 7, wherein the number of resilient finger spring assemblies per plate slot is more than one.

12. The apparatus of claim 7, wherein the array of plate slots and the number of resilient finger spring assemblies per plate slot are determined by the current rating desired.

13. The apparatus of claim 7, wherein the rated current range is from 600 amps to 6,000 amps.

14. The apparatus of claim 7, wherein the locator plate and guide plate geometries are rectangular, the locator plate further comprises two fixed arms of equal, predetermined length and height defining a predetermined width between the fixed arms each extending at right angles in the same direction from the locator plate front surface defining a predetermined width between the fixed arms, and the guide plate further comprises two notches of equal dimensions located at identical positions on each of the guide plate vertical sides defining a predetermined distance between the notch vertical sides and a predetermined notch height and sized to receive the fixed arms of the locator plate such that the arms pass through the notches, wherein the predetermined width of the fixed arms is slightly larger than the distance between the notch vertical sides and the predetermined notch height is slightly larger than the height of the vertical arms such that the guide plate slots correspond to the respective locator plate slots when the locator plate engages the guide plate.

15. The apparatus of claim 7, wherein the locator plate and guide plate geometries are circular.

16. Cluster switchgear assembly apparatus comprising:

at least one fixed conductor element comprising a predetermined cross-sectional area and a longitudinal axis defining a centerline;

at least one movable conductor element comprising a cross-sectional area corresponding to the fixed conductor element, a predetermined width, a longitudinal axis defining a centerline, and a dual 45 degree angled tapered tip, and wherein the fixed conductor and movable conductor elements are misaligned when the assembly is not engaged;

at least two primary fingers, each finger comprising a predetermined width, a predetermined length, a center point midway along the finger length, two ends, a top side comprising a circular spring locator to receive a spring assembly therein towards one end, and a bottom side comprising a locator slot located at the end of the bottom side opposite from the finger end having the circular spring locator, a guide slot located on the finger bottom side at a point slightly off the center point of the finger towards the locator slot, and a 45 degree taper on the end nearest the circular spring locator;

a finger spring for each finger, comprising a formed circular end suitably sized to be positioned within the finger top side spring locator, a deformed convex top side, a deformed concave bottom side, and a foot end wherein the deformed convex top side and the deformed concave bottom side define a leaf spring mechanism, wherein the finger spring formed circular end is positioned within the finger top side spring locator aligning the leaf spring mechanism so that the spring convex top side bows above the finger top side, and wherein the spring foot end rests on the finger top side providing a resilient finger spring assembly;

a flat non-magnetic metal locator plate of a predetermined surface geometry and size fixedly connected to the fixed conductor element, and further comprising a front surface, a back surface, a predetermined plate thickness, an array of slots of predetermined size and geometry through the plate surface to provide housing for at least one pair of oppositely opposed resilient finger spring assemblies wherein each such slot has a bottom edge, a top edge, and a predetermined width;

a flat non-magnetic metal guide plate comprising a surface geometry and size identical to the locator plate, and further comprising a front surface, a back surface, two vertical sides defining a predetermined plate thickness, an array of slots identical in size, location and geometry to the slots in the locator plate through the guide plate surface to provide housing for a plurality of oppositely opposed resilient finger spring assemblies wherein each such slot has a bottom edge, a top edge, and a predetermined width;

wherein each resilient finger spring assembly is positioned and resides within corresponding locator plate and guide plate slots by alignment of the respective finger locator slot for the locator plate and finger guide slot for the guide plate to positionally receive the corresponding edge of the locator plate and guide plate, wherein the finger spring deformed convex top side engages the corresponding locator plate and guide plate edges to secure each resilient finger spring assembly at a four degree angle of declination from the centerline of the movable conductor while allowing sufficient movement of the oppositely opposed resilient finger spring assemblies to receive and engage the movable conductor element tapered tip and full element width, and wherein such oppositely opposed pair of resilient finger spring assemblies defines a gap distance between the tapered finger assembly edges which is smaller than the width of the movable conductor element;

wherein the angle of declination of each resilient finger spring assembly is zero degrees from the centerline of the movable conductor element once the movable conductor element is engaged by the resilient finger spring assemblies; and wherein corresponding fixed and movable conductor element centerlines are aligned when the assembly is engaged.

17. The apparatus of claim 16, wherein the primary finger further comprises high conductivity copper 0.155 inches in thickness, and the primary finger is produced by stamping or similar high volume process.

18. The apparatus of claim 16, wherein the finger spring further comprises spring steel 18 gauge thick, 0.150 inches wide, and approximately 2 inches long, and the finger spring is produced by stamping or similar high volume process.

19. The apparatus of claim 16, wherein the locator plate and guide plate are each 10 gauge thick, and are manufactured using numerically controlled laser cutting equipment to easily vary plate sizes and shapes and to economically produce smaller numbers of parts.

20. The apparatus of claim 16, wherein the number of resilient finger spring assemblies per plate slot is more than one.

21. The apparatus of claim 16, wherein the array of plate slots and the number of resilient finger spring assemblies per plate slot are determined by the current rating desired.

22. The apparatus of claim 16, wherein the rated current range is from 600 amps to 6,000 amps.

23. The apparatus of claim 16, wherein the locator plate and guide plate geometries are rectangular, the locator plate further comprises two fixed arms of equal, predetermined length and height defining a predetermined width between the fixed arms each extending at right angles in the same direction from the locator plate front surface defining a predetermined width between the fixed arms, and the guide plate further comprises two notches of equal dimensions located at identical positions on each of the guide plate vertical sides defining a predetermined distance between the notch vertical sides and a predetermined notch height and sized to receive the fixed arms of the locator plate such that the arms pass through the notches, wherein the predetermined width of the fixed arms is slightly larger than the distance between the notch vertical sides and the predetermined notch height is slightly larger than the height of the vertical arms such that the guide plate slots correspond to the respective locator plate slots when the locator plate engages the guide plate.

24. The apparatus of claim 16, wherein the locator plate and guide plate geometries are circular.

* * * * *